US009004859B2

(12) United States Patent
Shahpar et al.

(10) Patent No.: US 9,004,859 B2
(45) Date of Patent: Apr. 14, 2015

(54) TURBOMACHINE COMPRISING AN ANNULAR CASING AND A BLADED ROTOR

(75) Inventors: Shahrokh Shahpar, Derby (GB); Ning Qin, Sheffield (GB); Yibin Wang, Sheffield (GB); Greg Carnie, Aberdeenshire (GB)

(73) Assignee: ROLLS-ROYCE plc, London (GB)

( * ) Notice: Subject to any disclaimer, the term of this patent is extended or adjusted under 35 U.S.C. 154(b) by 642 days.

(21) Appl. No.: 13/358,149

(22) Filed: Jan. 25, 2012

(65) Prior Publication Data

US 2012/0201671 A1 Aug. 9, 2012

(30) Foreign Application Priority Data

Feb. 3, 2011 (GB) ..... 1101811.6

(51) Int. Cl.

| | |
|---|---|
| ***F01D 1/04*** | (2006.01) |
| ***F04D 27/02*** | (2006.01) |
| ***F01D 11/08*** | (2006.01) |
| ***F01D 25/24*** | (2006.01) |
| ***F04D 29/16*** | (2006.01) |
| ***F04D 29/68*** | (2006.01) |

(52) U.S. Cl.

CPC ..... *F04D 27/02* (2013.01); *F01D 11/08* (2013.01); *F01D 25/24* (2013.01); *F04D 29/164* (2013.01); *F04D 29/681* (2013.01); *F05D 2250/184* (2013.01)

(58) Field of Classification Search

CPC ..... F01D 11/08; F01D 25/24; F04D 27/02; F04D 29/164; F04D 29/681; F05D 2250/184

USPC ..... 415/119, 173.1, 173.5, 914, 220

See application file for complete search history.

(56) References Cited

U.S. PATENT DOCUMENTS

| | | | | |
|---|---|---|---|---|
| 4,540,335 | A * | 9/1985 | Yamaguchi et al. | 415/129 |
| 4,767,266 | A | 8/1988 | Holz et al. | |
| 5,137,419 | A * | 8/1992 | Waterman | 415/170.1 |
| 5,707,206 | A * | 1/1998 | Goto et al. | 415/173.1 |
| 5,762,470 | A * | 6/1998 | Gelmedov et al. | 415/57.4 |
| 2007/0147989 | A1 * | 6/2007 | Collins | 415/173.1 |
| 2009/0246007 | A1 | 10/2009 | Johann | |
| 2010/0310353 | A1 | 12/2010 | Yu | |

FOREIGN PATENT DOCUMENTS

| | | | |
|---|---|---|---|
| EP | 1 101 947 | A2 | 5/2001 |
| SU | 926365 | A1 | 5/1982 |
| WO | WO 2009/125135 | A2 | 10/2009 |

OTHER PUBLICATIONS

British Search Report issued in Application No. 1101811.6; Dated May 12, 2011.

* cited by examiner

*Primary Examiner* — Igor Kershteyn
(74) *Attorney, Agent, or Firm* — Oliff PLC

(57) ABSTRACT

A casing treatment for a fan or compressor stage 10 of a gas turbine engine comprises circumferential grooves 16A, 16B, 16C, 16D and 16E which extend in a series disposed between the leading edges 20 and trailing edges 22 of blades 6 of a fan or compressor stage 10. The grooves 16 vary in depth d in order to optimise the stall margin of the fan or compressor stage 10 while preserving peak efficiency.

14 Claims, 2 Drawing Sheets

TURBOMACHINE COMPRISING AN ANNULAR CASING AND A BLADED ROTOR

This invention relates to a turbomachine comprising an annular casing and a bladed rotor, and is particularly, although not exclusively, concerned with a turbomachine in the form of a compressor or a fan in a gas turbine engine.

A gas turbine engine typically has a series of compressor stages which compress incoming air before it is combusted and exhausted through turbine stages, which drive the compressor stages. In some engines having a higher bypass ratio, a turbine-driven ducted fan may provide a substantial proportion of the propulsive thrust of the engine by delivering air directly into the surrounding air stream, without passing through the combustor and turbine stages of the engine. In both types of engine, the compressor stages and fans comprise bladed rotors which rotate within casings. In the context of this specification, the expression "rotor" embraces rotors of both compressors and fans.

It is important for compressors and fans to operate in a stable manner in which blade stall and compressor surge are avoided. For maximum efficiency, it is desirable for a running clearance between the tips of the rotor blades and the adjacent duct wall to be minimised. However, aerodynamic effects occurring at the blade tips can increase the likelihood of blade stall, and consequently the stall margin, which defines the limit of safe operation of the compressor or fan, is correspondingly restricted.

It is known to improve aerodynamic conditions at the blade tips, so as to increase the stall margin, by applying a casing treatment to the duct wall in the vicinity of the swept path of the blades. An example of such a casing treatment is disclosed in EP1801361, in which one or more helical grooves are provided in the duct wall. The grooves modify the flow regime at the blade tips to reduce the risk of blade stall, and the helical configuration of the groove or grooves enables debris entering the groove or grooves to migrate along the groove eventually to be ejected into the main airflow. Each helical groove progressively decreases in depth towards the forward or aft end of the casing treatment so that debris can be ejected smoothly into the main airflow.

In order to enhance the efficiency of an engine, it is desirable for any casing treatment grooves to be no deeper than necessary to achieve the desired aerodynamic improvements. While the helical grooves disclosed in EP1801361 vary in depth along their length, the purpose of the depth variation is to improve the ejection of debris from the grooves, and is not related to the aerodynamic requirements at the blade tips.

According to the present invention there is provided a turbomachine comprising an annular casing and a bladed rotor which is rotatable within the casing, each blade of the rotor having a leading edge and a trailing edge, and a blade tip which travels over a swept region of an internal surface of the casing, the swept region being provided with a series of axially spaced circumferential grooves, at least two of the grooves having different depths from each other.

The depths of the grooves may decrease monotonically from a groove having a maximum depth to a groove at the end of the series corresponding to the trailing edge of the blade. Alternatively, or in addition, the depth of the grooves may be decrease monotonically from the groove of maximum depth to a groove at the end of the series corresponding to the leading edge of the blade.

The axial chord (AC) of each blade is the axial distance, measured in a direction parallel to the rotary axis of the rotor, between the leading edge and the trailing edge. The depth of the groove of maximum depth may be not less than 15% and not more than 20% of the axial chord of the blade. The depth of the groove of minimum depth may be not less than 0.5% and not more than 2% of the axial chord. The groove of minimum depth may be the groove at the end of the series corresponding to the leading edges of the blades. The groove at the end of the series corresponding the trailing edges of the blades may have a depth which is not less than 10% and not more than 18% of the axial chord.

The gaps between adjacent ones of the grooves may have a substantially similar width across the series of grooves. This width may be not less than 6% and not more than 7% of the axial chord, particularly if the series comprises five grooves.

In some circumstances, it might be desirable for the gap between one pair of adjacent grooves to be slightly larger, for example 4% to 6% larger, than the gaps between other pairs of adjacent grooves. The pair of adjacent grooves having the larger gap may be situated not less than 30% and not more than 50% of the axial chord from the leading edges of the blades.

The forward most groove may be situated not less than 12% and not more than 16% of the axial chord from the leading edges of the blades. The aft most groove may be situated not less than 70% and not more than 80% of the axial chord from the leading edges of the blades.

The grooves may extend in the radial direction at an angle which is not less than 65° and not more than 95° to the rotational axis of the rotor. For some rotors, enhanced results are achieved if the angle of the groove is not less than 68° and not more than 75°. Another possible range of angles is from 85° to 95°, for example 90°.

The present invention also provides a gas turbine engine having a fan or compressor as defined above.

For a better understanding of the present invention, and to show more clearly how it may be carried into effect, reference will now be made, by way of example, to the accompanying drawings, in which:—

Figure 2:
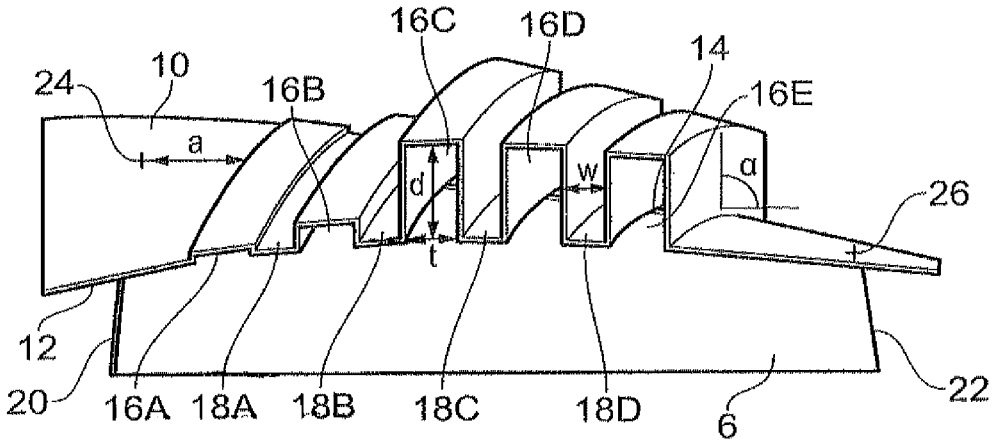
FIG. 2 is a schematic partial view of a casing and a blade tip of a rotor rotating within the casing.
Figure 3A:
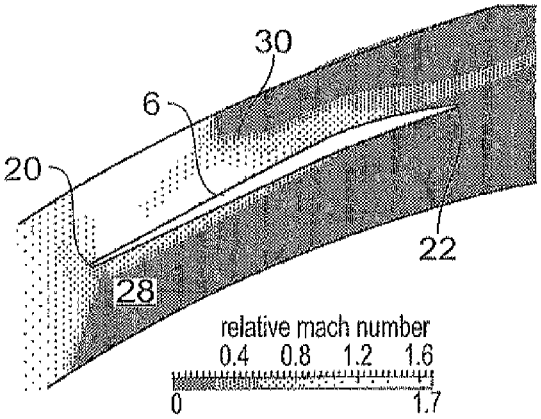
Figure 3B:
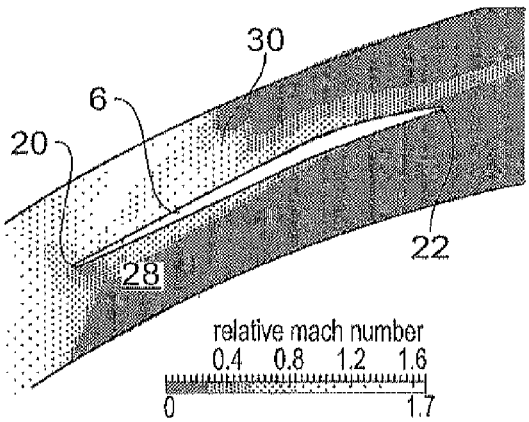
Figure 4:
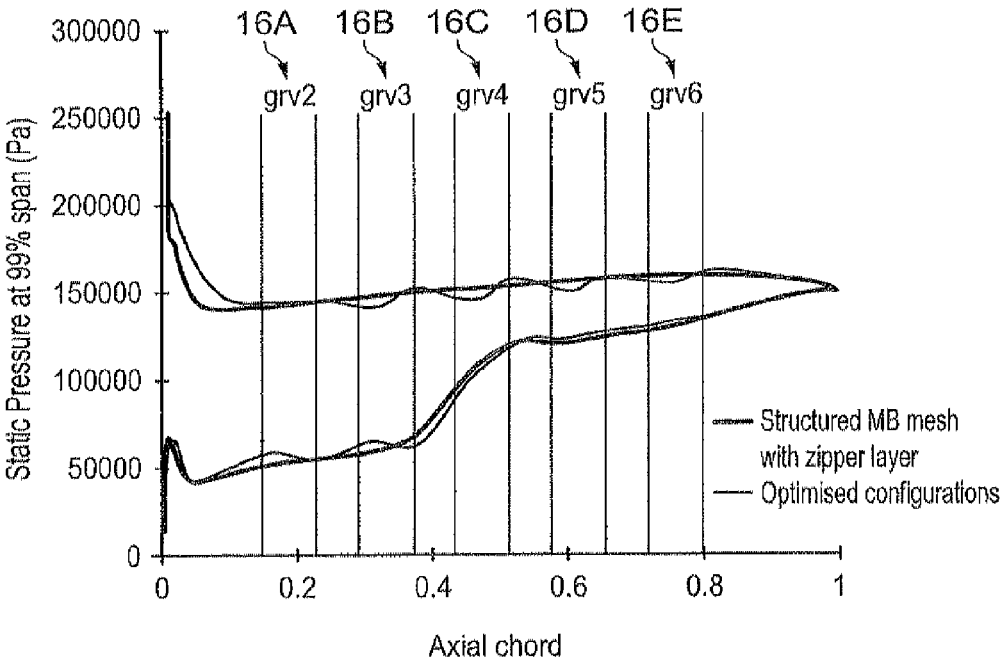

FIG. 3*a* represents airflow in the region of the blade tip of FIG. 2 in the absence of any casing treatment;

FIG. 3*b* corresponds to FIG. 3*a*, but represents the airflow in the presence of the casing treatment shown in FIG. 2; and FIG. 4 is a graph representing static pressure distribution over the pressure and suction surfaces of the blade at a position close to the blade tip.

Figure 1:
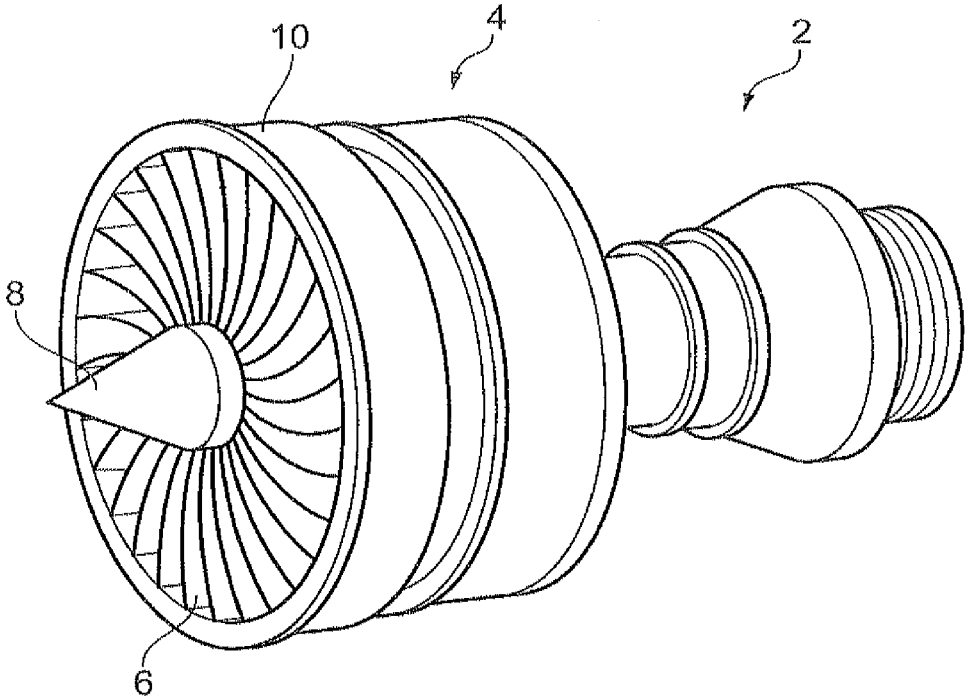
FIG. 1 is a schematic view of a high bypass gas turbine engine.

A gas turbine turbofan engine having a high by-pass ratio of the kind used to power commercial airliners and transport aircraft is illustrated in FIG. 1 as an example only of one type of engine in which the invention may be used. It is to be understood that it is not intended thereby to limit use of the invention to engines of that type. The invention will find application in turbojet engines in which the bypass ratio is very much less than a turbofan. Nor is it intended by illustrating an axial flow engine to exclude the invention from use with radial flow engines. Furthermore, although the invention is described below in connection with an engine, it need not inevitably be part of an engine and could be simply a rotary compressor or fan.

As illustrated in FIG. 1 the engine shown comprises a core, axial flow combustion section generally indicated at 2 and a fan section 4. The fan section 4 comprises an array of unshrouded fan blades 6 mounted around the periphery of a rotor disc 8 housed within an annular fan casing 10. The fan casing 10 is generally cylindrical and its inner surface 12 (FIG. 2) defines the radially outer wall of the flow path through the fan stage. The inner surface 12 of the casing 10 is spaced by a running clearance from the radially outer tips 14 of the rotor blades 6. The running clearance depends on several factors and varies under centrifugal loading and with temperature throughout an engine cycle. A build clearance is selected to ensure that the blade tips 14 do not rub the casing inner surface 12 when the engine is stationary or turning at low speed. As engine speed increases the clearance tends to reduce due to creep in the length of the blade under the influence of centrifugal forces. Thermal effects on the casing 10 and the rotor blades also have to be taken into account.

The efficiency of the fan rotor is influenced partly by the size of the running clearance. In general, the greater the clearance distance over the tips of the blades, the greater is the over tip leakage which lowers stage efficiency. In some instances in order to achieve the lowest practical running clearance the initial build clearance is set so that a tip rub is achieved at a predetermined engine speed. In such cases a sacrificial insert is set into the fan casing wall arranged to contact the blade tips 14 which then cut a track in the insert surface.

Another important fan performance factor is the stall margin. At the onset of stall conditions, mass flow through the fan is significantly reduced, and complete flow reversal can occur, a phenomenon known as surge. Fan or compressor surge in a gas turbine engine can have a catastrophic effect on the operation of the engine. It is therefore essential that the operating envelope of the engine is restricted to ensure that stall does not occur. The stall margin, or stability margin, represents the area between the normal working line of the fan or compressor and the stability line at which the onset of stall occurs. Consequently an improvement in the stall margin serves either to reduce the likelihood of stall during transient engine operation, or to enable the working line to be raised to increase the design performance of the engine.

Blade stall may be initiated by a reduction in the mass flow rate of air through the blades. Towards the radially outer casing wall the airflow speed falls rapidly owing to the boundary layer effect at the wall surface 12. As a result, the incoming air meets the radially outer tips 14 of the blades at a high angle of incidence, which can lead to separation of the flow from the suction side of the blades and the onset of stall.

In addition, under the effect of the pressure difference across each blade 14, leakage occurs over the tip of the blade. This leakage emerges at the suction side of the blade as a jet, which generates vortices in the spaces between the blades. These vortices have a blocking effect on the airflow past the blades, which reduces flow into the fan or compressor, again leading to increased angles of incidence.

Additional factors arise in transonic bladed rotors, in which adjacent regions of the airflow have subsonic and supersonic local velocities. Shock waves are formed which interact with tip leakage vortices, and this interaction can, again, lead to a blocking effect in the airflow between the blades.

To combat these effects the casing wall may be designed with so-called casing treatments that remove or re-circulate a proportion of the boundary layer, thus delaying or preventing onset of the airflow stall conditions.

A casing treatment in accordance with the present invention is shown in FIG. 2. Although the description above has referred specifically to the fan section 4, it will be appreciated that the same considerations apply also to compressor rotors of the core section 2. Consequently, references to the casing 10 and the blades 6 as shown in FIGS. 2, 3*a* and 3*b* apply equally to fan and compressor rotors and casings.

In the casing treatment of FIG. 2, the casing 10 is represented only by the inner surface 12 of the casing 10, but it will be appreciated that the casing itself will typically have a radial thickness extending outwardly of the surface 12.

The casing treatment comprises a series of grooves 16A, 16B, 16C, 16D and 16E. Thus, there are five grooves in the embodiment shown in FIG. 2, but it will be appreciated that other numbers of grooves may be appropriate, depending on the overall configuration of the rotor section 4.

Each of the grooves 16 is a circumferential groove, constituting a single ring extending around the array of blades 6. As shown in FIG. 2, the grooves 16 are of rectangular form having a depth d (shown only for the grooves 16C). Each groove has an axial thickness t (again shown only for the groove 16C), and adjacent grooves are spaced apart by gaps 18A, 18B, 180, 18D, having a width w.

Each blade 6 has a leading edge 20 and a trailing edge 22 which are projected onto the inner surface 12 at positions represented by points 24, 26. As the blades 6 rotate, each blade tip 14 travels over a swept region of the surface 12, which swept region is a circumferential path having axial ends which are defined by circles passing through the points 24, 26.

The series of grooves 16 lies entirely within the swept region so that the forward most groove 16A is aft of the leading edge 20, and the aft most groove 16E is forward of the trailing edge 22. In the embodiment shown in FIG. 2, the distance a between the leading edge circle passing through the point 24 and the forward most groove 16A is in the range 12% to 16% of the axial chord of the blade 6 (i.e. the axial distance between the points 24 and 26). For example, the distance a may be 14% to 15% of the axial chord. At the other end of the series of grooves 16, the corresponding distance to the aft most groove 16E may, for example, be in the range 70% to 80% of the axial chord. For the purposes of indicating the axial positions of the grooves 16, the measurement is taken from the points 24 to the forward most edge of the respective groove 16.

In accordance with the present invention, the depths d of the grooves 16 differ over the series of grooves. As shown in FIG. 2, the central groove 16C has the maximum depth d and the depths d of the grooves to either side of the maximum depth groove 16C decrease monotonically towards the leading and trailing edges 20, 22 of the blade 6 respectively. The groove 16A and 16B forward of the groove 16C have substantially smaller depths than the grooves 16D and 16E aft of the groove 16C for reasons which will be described below. By way of example, the depths of the grooves 16 may be as follows, with the depths being expressed as a percentage of the axial chord (% AC):

groove 16A: 1.1% AC;
groove 16B: 4.3% AC;
groove 16C: 17.5% AC;
groove 16D: 17.0% AC;
groove 16E: 16.1% AC The uniform thickness t of the grooves may be 8.3% AC.

The casing treatment shown in FIG. 2 with the dimensions referred to above was derived following computational fluid dynamics (CFD) modelling of a transonic rotor known as NASA rotor 37, followed by a subsequent optimisation process. The casing treatment of FIG. 2 was compared with models representing a rotor with no casing treatment (i.e. a plain cylindrical inner surface 12), and a reference casing treatment model in which the grooves 16 have equal depths of 3.6% AC and a groove width of 8% AC. The results are presented in Table 1 below:

| | SM(%) | ΔSM(%) | $\eta_{Peak}$(%) | $\Delta\eta_{Peak}$ (%) |
|---|---|---|---|---|
| No casing treatment | 15.061 | — | 85.831 | — |
| Reference groove configuration | 15.760 | 0.700 | 85.089 | −0.742 |
| Optimum groove configuration | 15.787 | 0.726 | 85.776 | −0.055 |

Table 1 demonstrates that the optimum groove configuration of FIG. 2 provides an improvement in stall margin (SM) comparable to that of a series of equal-depth grooves, but with a lower penalty in peak efficiency ($\eta_{Peak}$ %).

In the above model based on NASA rotor 37, the forward most groove 16A is spaced by a distance a of 14.3% AC from the leading edge 20. Using the CFD model, investigation was made to establish the effect of deviating from this distance by displacing the series of grooves 16 so that the forward most groove 16A is situated forward of, and aft of, the 14.3% AC position. The results are shown in Table 2 below:

| 1st groove position (% Axial Chord) | ΔSM |
|---|---|
| 14.3 | 0.73 |
| 11 | −0.27 |
| 17.6 | −0.60 |

This demonstrates that displacement of the series of grooves 16 either in the forward direction or the aft direction carries a penalty in terms of stall margin.

During the optimisation process, the width w of the gap between adjacent grooves 16 was varied, but a common gap size was maintained between all adjacent groove pairs. For the optimised case, the width w was 6% AC. Simulations were run in which each of the gaps 18A, 18B, 18C and 18D were enlarged in turn to a width w of 6.3% AC. The remaining gaps remained at a width w of 6% AC. The results are shown in Table 3 below:

| | Width w of gaps between grooves % AC: | | | | |
|---|---|---|---|---|---|
| case | 18A | 18B | 18C | 18D | ΔSM |
| 1 | 6.3 | 6 | 6 | 6 | 0.72 |
| 2 | 6 | 6.3 | 6 | 6 | 0.75 |
| 3 | 6 | 6 | 6.3 | 6 | 0.72 |
| 4 | 6 | 6 | 6 | 6.3 | 0.73 |
| Original | 6 | 6 | 6 | 6 | 0.73 |

It will be appreciated that variation of the width w of gaps 18A, 18C and 18D made relatively little difference to the stall margin. However, an increase in the width of gap 18B increases the stall margin suggesting that stall occurs at a lower mass flow rate through the rotor while maintaining the peak conditions. The simulation also indicates that the casing treatment design is sufficiently robust to maintain the stall margin despite manufacturing or positioning errors in the rotor and the casing provided that the forward most groove position is accurately maintained.

FIGS. 3*a* and 3*b* represent local flow velocities around the blade 6 at the blade tip (i.e. at a section positioned at 99% of the blade span) at the onset of stall. FIG. 3*a* shows the velocity profile with no casing treatment, and FIG. 3*b* shows the velocity profile with a casing treatment as shown in FIG. 2. FIG. 4 represents the pressure distribution around the blade 6, with the darker line representing the pressure distribution with no casing treatment, and the lighter line representing the pressure distribution with a casing treatment as shown in FIG. 2. FIGS. 3*a* and 3*b* show a high load region 28 towards the leading edge 20 of the blade 6, when the static pressure on the pressure side of the blade is high. This region typically extends over 0-10% AC from the leading edge 20. FIGS. 3*a* and 3*b* also show a shock 30 between subsonic and supersonic flow.

It will be appreciated from FIGS. 3*a*, 3*b* and 4 that the forward most groove 16A is situated aft of the high load region 28. The groove 16B terminates axially at the start of the shock 30. As shown by the lower curves in FIG. 4 representing the pressure distribution over the suction side of the blade 6, the casing treatment displaces the position of the shock in the aft direction.

The groove 16C is positioned at the foot of the shock 30, i.e. at the position where the shock meets the blade 6. It will be appreciated from FIG. 3*b* that the presence of the grooves 16 causes disruption of the shock 30.

It is also clear from comparison of FIGS. 3*a* and 3*b* that the presence of the grooves 16C, 16D and 16E increases the fluid velocity in the passage between adjacent blades 6 so that the blockage of the passage by slow-moving airflow (represented dark in FIGS. 3*a* and 3*b*) is reduced. This increase in the velocity of the fluid helps to prevent the rotor from stalling.

In FIG. 2 the grooves 16 are shown extending axially away from the tip of the blade 6. Thus, the grooves can be considered to extend at an angle α of 90° from the axial direction, as shown in FIG. 2. A simulation was carried out in which the grooves 16 are inclined at different angles to the axial direction. It was found that increasing the angle α above 90° reduced the stall margin, while some ranges of angle less than 90° produced an improvement in stall margin. In particular, a groove angle α in the range 68 to 75° showed good results.

In accordance with the present invention, the groove depths d are determined on the basis of the complex flow conditions at different positions along the chord of the blade 6. Thus, groove depths d are minimised for those grooves, such as 16A and 16B, where an optimised stall margin can be achieved with relatively shallow grooves. Thus, the effective tip clearance at these grooves remains relatively small, avoiding tip leakage losses, so enabling peak efficiency to be maintained. The groove depths d are thus influenced by their position along the blade chord, and take account of the complex flow physics which vary significantly between the leading edge 20 and the trailing edge 22. In particular, the deeper grooves are positioned at a significant distance a from the leading edge of the blade and the series of grooves 16 terminates at the groove 16E, significantly ahead of the trailing edge 22. This avoids the provision of grooves in regions where they make little or no contribution to the improvement in stall margin.

As mentioned above, the CFD simulation by which the casing treatment of FIG. 2 was derived was NASA rotor 37. It will be appreciated that different casing treatment profiles may be required for different rotors, although it is expected that the general casing treatment profile described herein would be applicable to different rotors.

The invention claimed is:

1. A turbomachine comprising an annular casing and a bladed rotor which is rotatable within the casing, each blade of the rotor having a leading edge and a trailing edge, and a blade tip which travels over a swept region of an internal surface of the casing, the swept region being provided with a series of axially spaced circumferential grooves, each groove comprising a separate ring;

wherein:

the depths of the grooves decrease monotonically from one of the grooves having a maximum depth to a groove at the end of the series corresponding to the trailing edge; and the depths of the grooves decrease monotonically from the groove having the maximum depth to a groove at the end of the series corresponding to the leading edge.

2. A turbomachine as claimed in claim 1, in which the groove having the maximum depth has a depth that is not less than 15% and not more than 20% of the axial chord of the blade.

3. A turbomachine as claimed in claim 1, in which the groove having the minimum depth has a depth which is not less than 0.5% and not more than 2% of the axial chord.

4. A turbomachine as claimed in claim 3, in which the groove having the minimum depth is at the end of the series corresponding to the leading edge of the blade.

5. A turbomachine as claimed in claim 1, in which the groove at the end of the series corresponding to the trailing edge of the blade has a depth which is not less than 10% and not more than 18% of the axial chord.

6. A turbomachine as claimed in claim 1, in which the gaps between adjacent ones of the grooves have a substantially identical width across the series of grooves.

7. A turbomachine as claimed in claim 6, in which the width of each gap is not less than 6% and not more than 7% of the axial chord.

8. A turbomachine as claimed in claim 1, in which the gap between a pair of adjacent grooves situated not less than 30% and not more than 50% of the axial chord from the leading edge of the blade is slightly larger than the gaps between other adjacent pairs of the grooves.

9. A turbomachine as claimed in claim 1, in which the forward most groove is situated not less than 12% and not more than 16% of the axial chord from the leading edge of the blade.

10. A turbomachine as claimed in claim 1, in which the aft most groove is situated not less than 70% and not more than 80% of the axial chord from the leading edge of the blade.

11. A turbomachine as claimed in claim 1, in which the depth of each groove extends at an angle of not less than 65° and not more than 95° to the axial direction of the rotor.

12. A turbomachine as claimed in claim 11, in which the depth of each groove is at an angle of not less than 68° and not more than 75° to the axial direction of the rotor.

13. A turbomachine as claimed in claim 11 in which the depth of each groove extends at an angle of not less than 85° and not more than 95° to the axial direction of the rotor.

14. A turbomachine as claimed in claim 1, in which the groove of maximum depth is situated approximately at the location of the shock at stall conditions on the suction side of the blade.

* * * * *